US005890942A

United States Patent [19]

Souza-Ferreira et al.

[11] Patent Number: 5,890,942

[45] Date of Patent: Apr. 6, 1999

[54] SIMULATED DIVING MASK AND SNORKEL FOR DOLL

[75] Inventors: Odette M. Souza-Ferreira, Redondo Beach; Toshio Yamasaki, Long Beach, both of Calif.

[73] Assignee: Mattel, Inc., El Segundo, Calif.

[21] Appl. No.: 910,597

[22] Filed: Jul. 31, 1997

[51] Int. Cl.[6] ..... A63H 33/28

[52] U.S. Cl. ..... 446/18; 446/21; 446/197; 446/268

[58] Field of Search ..... 446/15, 16, 17, 446/18, 19, 20, 21, 153, 318, 483, 180, 183, 197, 198, 268

[56] References Cited

U.S. PATENT DOCUMENTS

| | | | |
|---|---|---|---|
| 2,032,192 | 2/1936 | Wheeler, Jr. | 446/153 |
| 2,700,245 | 1/1955 | Kratt et al. | 446/17 |
| 2,842,894 | 7/1958 | Walden | 446/18 |
| 2,853,829 | 9/1958 | Greene . | |
| 3,093,925 | 6/1963 | Greene . | |
| 4,232,476 | 11/1980 | Lieberman . | |
| 4,276,713 | 7/1981 | Crosbie . | |
| 4,556,392 | 12/1985 | Chang . | |
| 4,708,135 | 11/1987 | Arkema . | |
| 4,840,597 | 6/1989 | Perez . | |
| 4,964,827 | 10/1990 | Rudy . | |
| 4,995,844 | 2/1991 | McNett et al. . | |
| 5,238,437 | 8/1993 | Vowles et al. . | |
| 5,671,728 | 9/1997 | Winefordner et al. . | |

*Primary Examiner*—Robert A. Hafer
*Assistant Examiner*—Jeffrey D. Carlson
*Attorney, Agent, or Firm*—Roy A. Ekstrand

[57] ABSTRACT

A conventional doll receives and supports a combination diving mask and simulated snorkel unit. The combination diving mask and snorkel unit includes a mask body supporting a transparent faceplate and a snorkel mouthpiece. A snorkel body secured to the mouthpiece extends upwardly alongside the mask body and supports a resilient air bladder having a fish shape. The snorkel further includes a bubble blowing mechanism which is operative in response to squeezing of the fish-shaped air bladder to produce a plurality of bubbles emanating from the upper portion of the snorkel body.

11 Claims, 3 Drawing Sheets

SIMULATED DIVING MASK AND SNORKEL FOR DOLL

FIELD OF THE INVENTION

This invention relates generally to dolls or toy figures and particularly to dolls or toy figures utilizing bubble blowing apparatus.

BACKGROUND OF THE INVENTION

Throughout the years, a great many of toy figures, dolls and other toys have been created which utilize bubble-making features in one of several manners. The basic bubble-making apparatus includes a reservoir having a bubble forming solution, usually a soap and water based mix, together with one or more apertured elements or rings and a source of pressurized air. In operation, the apertured element or ring is moved initially into the reservoir and immersed in the bubble making fluid afterwhich the apertured element or ring is withdrawn from the reservoir such that a film of bubble fluid is formed across the aperture or apertures. The apertured element or ring is then carried into the pressurized air stream resulting in the creation of one or more bubbles being formed as the pressurized air is forced through the apertures or ring. In many devices, a single ring having a single center aperture forms the primary bubble blowing element while in other devices a plurality of apertures are formed in a multiapertured element intended to provide simultaneous creation of a plurality of bubbles when exposed to the air stream.

In response to the continued and long term popularity of bubble making toys, practitioners in the art have provided a virtually endless variety of such devices. Perhaps the simplest of bubble making toys is provided by a simple ring supported upon a wand or handle which is immersed by hand into a bottle of fluid and which is then brought to proximity with the user's mouth allowing the user to simply blow through the ring and form bubbles. Alternatively, the user may wave the ring about in the air rather than blow through the ring. More sophisticated apparatus have been provided which utilize a resilient air bellows of some type together with a piston driven ring support. The resulting structure allows the user to squeeze or deform an air bellows producing pressurized air which simultaneously acts upon the piston and provides a vented air stream through a nozzle aperture. The piston supports a bubble blowing ring and piston travel is selected to move the ring from immersion in the fluid to alignment with the nozzle. As a result, a single squeeze of the elastic resilient bellows moves the ring from the fluid into alignment with the nozzle and directs a stream of air through the ring aperture forming one or more bubbles. A still more sophisticated apparatus has been provided in which a battery-powered electric motor drives a fan producing a continuous air stream while a plurality of bubble blowing rings are moved between fluid immersion and alignment with a nozzle. The latter is coupled to the power driven fan and directs a stream of pressurized air through the bubble-blowing rings as they are brought into alignment with the nozzle. The advantage of such battery powered units is the seemingly continuous creation of bubbles without user effort. Each of the above general types of bubble producing toys has been subject to substantial variation as practitioners endeavor to improve, the interest, amusement and attractiveness of bubble blowing toys.

U.S. Pat. No. 2,853,829 issued to Greene sets forth a TOY having a resilient elastic toy figure body in which the figure torso forms a squeezable deformible air bulb and in which a movable piston assembly is supported within the figure neck. An aperture is formed in the neck portion of the piston assembly. The figure's head and a downwardly projecting bubble blowing ring are movable vertically in response to piston motion as the figure's body is squeezed. A fluid reservoir is supported at the chest area of the figure and receives the bubble blowing ring in the absence of torso squeezing. As the torso is squeezed, the piston drives the head and bubble ring upwardly removing the bubble ring from the reservoir and aligning it with the aperture. The air stream vented through the aperture causes bubbles to be formed.

U.S. Pat. No. 3,093,925 issued to Greene sets forth a BUBBLE MAKING TOY having an elongated handle supporting a collapsible bellows at its lower end and a simulated animal figure at its upper end. An air passage is coupled between the bellows and the figure's head. Within the head, a reservoir is formed and a piston and cylinder assembly together with a bubble blowing ring is movable in response to pressure within the air passage to raise the bubble blowing ring into alignment with an air venting aperture. In addition, the upper forward and upper jaw of the simulated figure is pivotally supported and pivots upwardly under the urging of piston movement to open the figure's mouth. In operation, the user forces the bellows downwardly against the ground causing air pressure to be forced upwardly through the handle passage raising the bubble ring and opening the figure's mouth resulting in a discharge of bubbles from the figure's open mouth.

U.S. Pat. No. 4,276,713 issued to Crosbie sets forth a PERCOLATING BUBBLE GENERATOR having a pistol like body supporting a resilient air bellows and movable trigger mechanism. The trigger mechanism when squeezed causes collapse of the air bellows producing a stream of pressurized air. The pressurized air is directed by a nozzle into a bubble percolating mechanism. The bubble percolating mechanism supports a quantity of bubble fluid together with air passages which cause the fluid to foam within the percolating mechanism and form bubbles which are forced outwardly through an aperture in the forward surface of the bubble percolating mechanism.

U.S. Pat. No. 4,556,392 issued to Chang sets forth an BUBBLING SELF-PROPELLED TOY in the form of a bubbling octopus. A bubble blowing means and drive mechanism are operated from a battery power electric motor source. The motor turns an air fan as the toy is propelled producing a pressurized air stream vented forwardly through the figure's nostrils. An articulated arm supports a bubble blowing ring and is cyclically moved between a first position immersing the ring in a double fluid reservoir and a second position aligning the ring with the nostrils of the figure. The combined action provides a self-propelled figure which repeatedly blows a series of bubbles as it moves about.

U.S. Pat. No. 4,840,597 issued to Perez sets forth a DOLL WITH MEANS FOR PRODUCING SOAP BUBBLES AND HAVING ANTISPILL CONTAINER in which a bubble making tool having a ring-shaped end is attached to a movable arm of the doll. The arm is able to pivot about the trunk so as to dip the tool into a liquid reservoir and raise it to a mouth opening formed in the doll. An air impeller is located within the doll's head and is operative to force air out of an aperture in the doll's mouth each time the arm is moved to its raised position. Both the arm movement mechanism and the air impeller are driven by a battery-powered motor within the doll torso.

U.S. Pat. No. 4,995,844 issued to McNett, et al. sets forth a BUBBLE BLOWING TOY FIGURE having a hollow torso configured with a head portion defining a mouth opening and a squeezable body portion. An apparatus is supported within the torso which is operative to produce a plurality of bubbles emanating from the figure's mouth as the torso is squeezed.

U.S. Pat. No. 5,238,437 issued to Vowles, et al. sets forth a BUBBLE DISPENSING DOLL having a hollow torso and head configured to resemble a mermaid. The doll head supports a quantity of simulated hair and a head piece ornament configured to resemble a crown. A bubble producing mechanism is formed into an integral self-supporting apparatus which is received and supported within an upper aperture of the doll's head. The bubble producing mechanism includes a battery-powered air impeller which drives an air stream through a foaming chamber within the bubble producing mechanism.

U.S. Pat. No. 4,964,827 issued to Rudy sets forth a FLOATATION DEVICE FOR SWIMMERS having a buoyant figure which is securable a child's upper arm.

While the foregoing described prior art devices are illustrative of the art and have in several instances enjoyed commercial success, there remains nonetheless a continuing need in the art for evermore amusing, entertaining and improved bubble producing toys.

SUMMARY OF THE INVENTION

Accordingly, it is a general object of the present invention to provide an improved bubble producing toy. It is a more particular object of the present invention to provide a simulated bubble producing diving mask for use in combination with a swimming doll. It is a still more particular object of the present invention to provide an improved simulated diving mask for use in a swimming doll which resembles a snorkel device and which produces a novel play pattern for the child user.

In accordance with the present invention, there is provided a simulated diving mask and snorkel for a doll comprising: a mask having a mask body, a faceplate and means for securing the mask body to a doll head; a simulated snorkel having a mouthpiece joined to the mask body and a hollow snorkel body joined to the mouthpiece extending upwardly alongside the mask body; a bubble fluid reservoir supported within the snorkel body having a quantity of bubble fluid disposed therein; a resilient hollow air bladder having an air passage fitting; a fitting joined to the snorkel body for receiving and securing the passage fitting of the bladder; a slide and piston movable within the snorkel body between a raised position and a lowered position; a vent aperture formed within the snorkel body above the reservoir, the vent aperture being blocked from communication with the air bladder when the slide and piston are in the raised position; and a bubble ring joined to and supported by the slide, the bubble ring being immersed in the fluid when the slide is in the lowered position and raised to alignment with the vent aperture when the slide is in the raised position, whereby squeezing of the air bladder forces pressurized air into the snorkel body to raise the slide and piston and to vent air through the vent aperture thereby producing bubbles emanating from the snorkel body.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
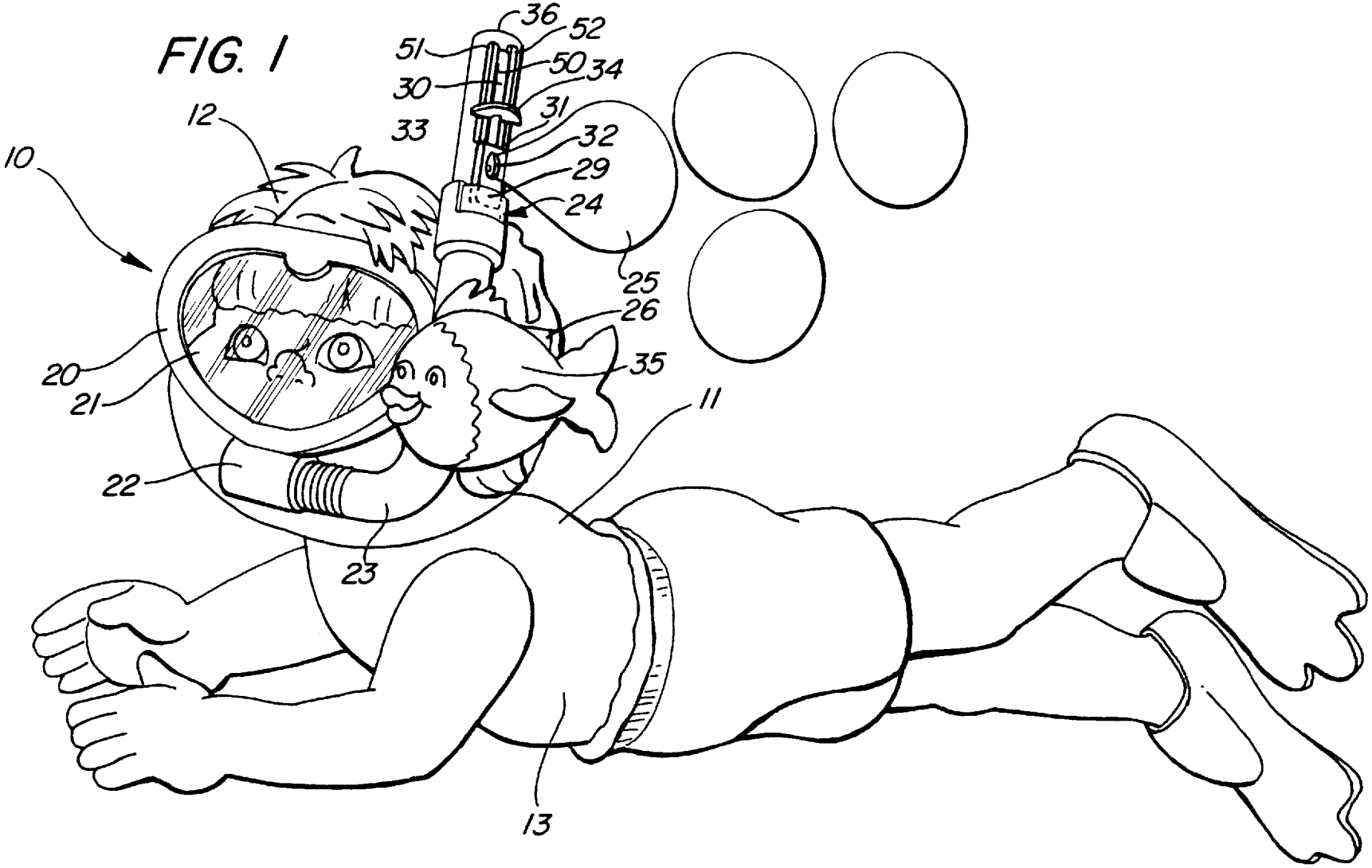
FIG. 1 sets forth a perspective view of a simulated diving mask and snorkel for doll constructed in accordance with the present invention and operatively secured to a conventional doll.

FIG. 1 sets forth a perspective view of a simulated diving mask and snorkel constructed in accordance with the present invention and generally referenced by numeral 10. Diving mask 10 is shown secured to a conventional doll 11. Doll 11 is fabricated in accordance with conventional fabrication techniques and includes a head 12 supported upon a torso 13. Doll 10 may be entirely of conventional fabrication and does not interact with diving mask 10 in an operative sense.

Diving mask 10 includes a mask body 20 preferably formed of a resilient plastic or rubber material and supporting a transparent faceplate 21. A mouthpiece 22 is integrally formed with mask body 20 and is positioned in an overlying relationship to the mouth of doll 11 (not shown). Mask body 20 is secured to head 12 of doll 11 by a strap 26. Strap 26 may, alternatively, be formed of a resilient rubber or plastic material or may include a buckle or hoop and loop fabric attachment. The essential function of strap 26 is to secure diving mask 10 upon head 12 of doll 11.

In accordance with the present invention, diving mask 10 further includes a snorkel body 23 formed of a hollow plastic material and joined to mouthpiece 22. Snorkel body 23 extends upwardly alongside mask body 20 and terminates in a closed end 36. Snorkel body 23 further includes a fluid reservoir 24 within which a quantity of bubble making fluid is received in the manner set forth below. Reservoir 24 further includes a transparent window 29 which facilitates observation of the fluid level within reservoir 24. Snorkel body 23 further defines an elongated slot 50 and a pair of elongated guides 51 and 52 on each side thereof. A movable slide 30 is received within snorkel body 23 in the manner set forth below in greater detail. Suffice it to note here that slide 30 is movable vertically within slot 50. Slide 30 further supports a cap 34 configured to provide closure of reservoir 24 and a bubble ring 31. The latter defines an aperture 32. By means set forth below in greater detail, a source of pressurized air is provided within snorkel body 23 and flows outwardly through an aperture 33.

Diving mask 10 further includes a resilient air bladder 35 operatively coupled to snorkel body 23 in the manner set forth below in FIG. 3. Air bladder 35 is fabricated of a resilient rubber or plastic material and in the embodiment shown in FIG. 1 is formed to resemble a small fish. It will be apparent to those skilled in the art, however, that air bladder 35 may be formed to provide any number of appearances preferably with an undersea or aquatic theme such as a clam shell or the like.

In operation, with diving mask 10 supported upon doll 11 in the manner shown in FIG. 1, slide 30 is urged downwardly in response to gravitational force thereby immersing bubble ring 31 within reservoir 24 and positioning cap 34 upon the upper portion of reservoir 24. The user actuates the bubble blowing mechanism of diving mask 10 by squeezing air bladder 35 with sufficient force to drive slide 30 upwardly to the position shown in FIG. 1. The operative mechanism which moves slide 30 upwardly as air bladder 35 is squeezed is set forth below in FIGS. 2 through 4 in greater detail. However, suffice it to note here that squeezing air bladder 35 produces a pressurized air condition within snorkel body 23 which performs the dual functions of raising slide 30 and directing a stream of pressurized air outwardly through aperture 33. It will be noted that as slide 30 is raised, it also raises bubble ring 31 to a position in which aperture 32 thereof is aligned with the pressurized air flow emanating from aperture 33. As a result, a plurality of bubbles such as bubble 25 are formed as air passes through aperture 32 of bubble ring 31.

Once the user releases air bladder 35, the negative air pressure within snorkel body 23 and gravitational force again draws slide 30 downwardly once again immersing bubble ring 31 within reservoir 24. This activity may be repeated as the user squeezes and releases air bladder 35 to provide intermittent bubbling of the snorkel portion of diving mask 10 simulating the production of bubbles which occurs in diving equipment. Because diving mask 10 and snorkel body 23 as well as air bladder 35 are fabricated to form an integral unit, the present invention diving mask assembly may be removed from doll 11 and placed upon another suitably sized doll as the child user wishes. In the preferred fabrication of diving mask 10, all components may be fabricated of a molded plastic or resilient plastic material which substantially decreases the manufacturing costs of the diving mask.

Figure 2:
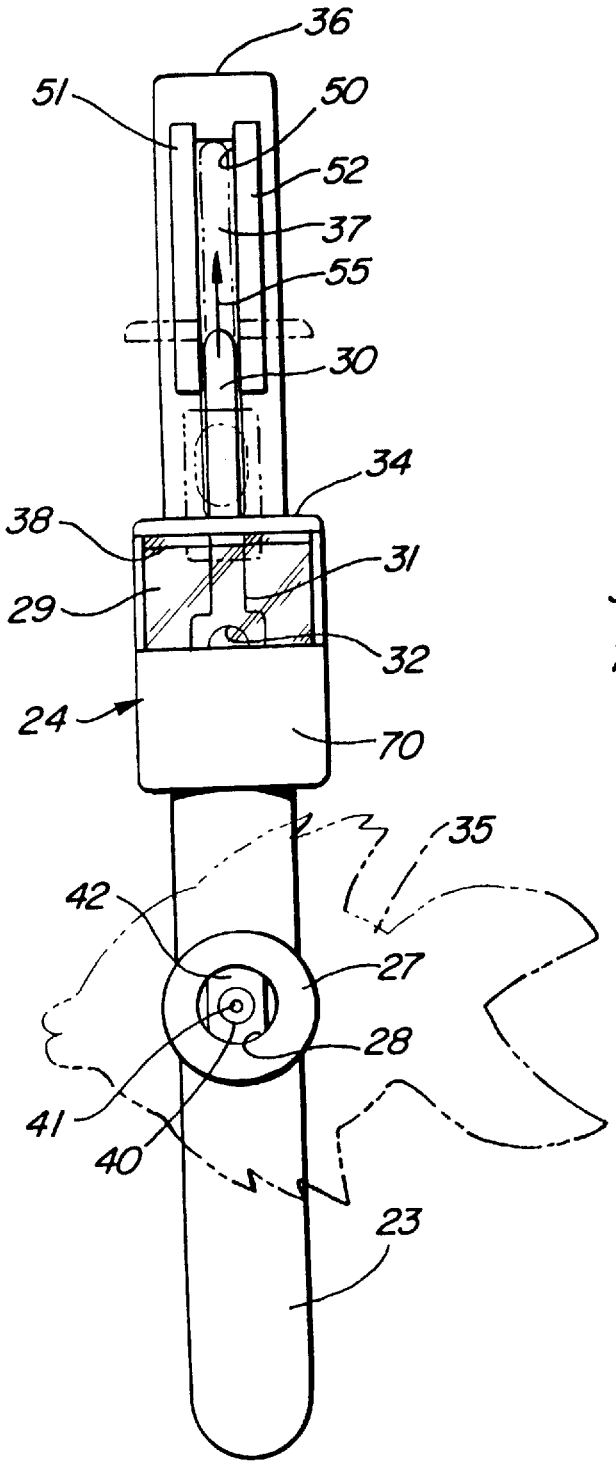
FIG. 2 sets forth a side elevation view of the snorkel portion of the present invention simulated diving mask and snorkel.

FIG. 2 sets forth a side elevation view of snorkel body 23 having air bladder 35 shown in dashed-line phantom. In the drawing of FIG. 2, the components within snorkel body 23 are shown in their relaxed position (in the absence of pressurized air from squeezing air bladder 35) and thus no bubbles are being produced. As described above, snorkel body 23 includes a reservoir 24 and a closed end 36. As is also described above, snorkel body 23 is substantially hollow and includes an elongated slot 50 having guides 51 and 52 formed on each side thereof.

Reservoir 24 includes an expanded reservoir support 70 which is integrally formed with snorkel body 23. Reservoir 24 further includes a transparent reservoir tank unit 71 (seen in FIG. 3) received within reservoir support 30. Tank unit 71 includes a transparent window 29 which allows a observation of the fluid level of bubble forming fluid 38 within reservoir 24 to be observed.

As described above, slide 30 is movable within slot 50 of snorkel body 23 and supports a reservoir cap 34 together with a bubble ring 31. Bubble ring 31 defines an aperture 32.

Snorkel body 23 further includes a fitting 27 defining a center aperture 28. As is better seen in FIG. 3, fitting 27 and aperture 28 cooperate to provide attachment of air bladder 35 to snorkel body 23. As is also better seen in FIG. 3, an air plenum 42 includes a nozzle 40 defining a passage 41 therethrough. Nozzle 40 cooperates with fitting 27 to couple air bladder 35 to air plenum 42 assuring the pressurized air provided by squeezing air bladder 35 is directed properly to the operative mechanism within snorkel body 23.

In the closed position shown in FIG. 2, air bladder 35 is relaxed and slide 30 is maintained in its lowered position in which cap 34 is resting upon the upper edge of reservoir 24. In this manner, cap 34 helps to maintain the integrity of reservoir 24 and avoid spilling of the fluid therein. When the user squeezes air bladder 35, a rush of pressurized air is directed through passage 41 and by means set forth below in greater detail causes slide 30 to rise in the direction indicated by arrow 55.

As slide 30 rises, ring 31 is drawn upwardly bearing a quantity of bubble producing fluid. As slide 30 reaches the top of slot 50, aperture 32 of ring 30 is aligned with an air nozzle (nozzle aperture 33 in FIG. 3). The outward air flow from nozzle 33 forces air through aperture 33 of ring 31 producing bubbles in the manner set forth above in FIG. 1. Once the user releases air bladder 35, slide 30 again descends to the position shown in FIG. 2. Thus, repeated squeezing and release of air bladder 35 repeatedly raises slide 30 and produces a stream of bubbles followed by a return of slide 30 and ring 31 to the relaxed position shown in FIG. 2.

Figure 3:
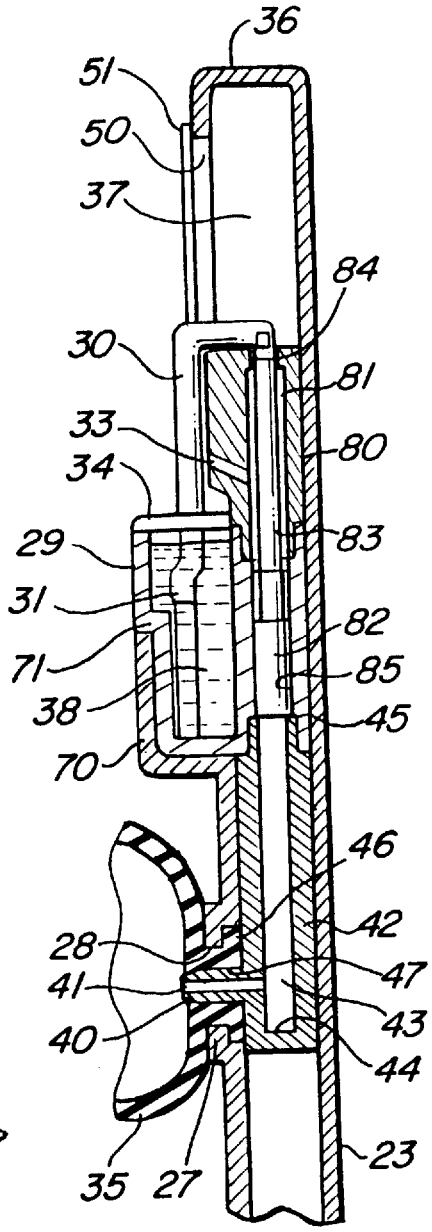
FIG. 3 sets forth a partial section view of the bubble producing portion of the present invention simulated diving mask and snorkel in the relaxed or non-bubble producing position.

FIG. 3 sets forth a partial section view of the snorkel portion of the present invention diving mask showing the mechanism therein in the relaxed position of FIG. 2. Thus, snorkel body 23 defines an interior passage 37 and an elongated slot 50. Snorkel body 23 further defines a closed end 36 and a fitting 27. Fitting 27 defines an aperture 28. An air bladder 35 defines an aperture 27 and a lip 46 configured to interlock with fitting 27 and secure air bladder 35 to snorkel body 23. Within passage 37 of snorkel 23, an elongated cylindrical plenum 42 having a chamber 43 and a closed end 44 is secured. Plenum 42 further includes a nozzle 40 having a passage 41 therethrough which extends into aperture 47 of air bladder 35. The resulting combination of plenum 42, fitting 27 and lip 46 of air bladder 35 secures air bladder 35 to snorkel body 23 in communication with chamber 43.

Snorkel body 23 further defines a reservoir support portion 70 which receives a reservoir tank unit 71. Tank unit 71 is preferably formed of a transparent material and includes a window 29 and a cylinder 85. Cylinder 85 receives a slidable piston 82. A cylindrical boss 45 extends upwardly from plenum 42 into tank unit 71. In the relaxed position shown in FIG. 3, piston 82 rests upon the upper surface of boss 45. A quantity of bubble making fluid 38 is received within tank unit 71.

A movable slide 30 is slidably received within slot 50 and extends into passage 37 of snorkel body 23. A piston rod 83 couples the interior end of slide 30 to the upper end of piston 82 while the outer end of slide 30 supports cap 34 and bubble ring 31.

A nozzle body 80 is received within passage 37 of snorkel body 23 and defines a passage 81 and an upper aperture 84. Piston rod 83 extends downwardly through aperture 84 and passage 81. Also formed in nozzle body 80 is a nozzle aperture 33. In the preferred fabrication of the present invention, nozzle body 80 is sealingly secured to tank unit 71. As a result, the position of piston 82 at the lower end of cylinder 85 prevents air flow from chamber 43 of plenum 42 and nozzle aperture 33.

Thus, in this position, bubble ring 31 is immersed within fluid 38 of reservoir 24 and piston 82 rests upon boss 45. Once the user squeezes air bladder 35, however, a burst of pressurized air flows through passage 41 of nozzle 40 pressurizing chamber 43 and producing an air pressure force against piston 82 urging it upwardly. Under the force of pressurized air, piston 82 is driven upwardly from cylinder 85 into passage 81 of nozzle body 80. This upward movement of piston 82 also carries piston rod 83 and slide 30 upwardly which in turn raises ring 31. The upward travel of slide 30 is limited by the upper end of slot 50. Thus, as the user continues to squeeze air bladder 35, slide 30 is driven against the upper end of slot 50 and the mechanism assumes the position shown in FIG. 4.

Figure 4:
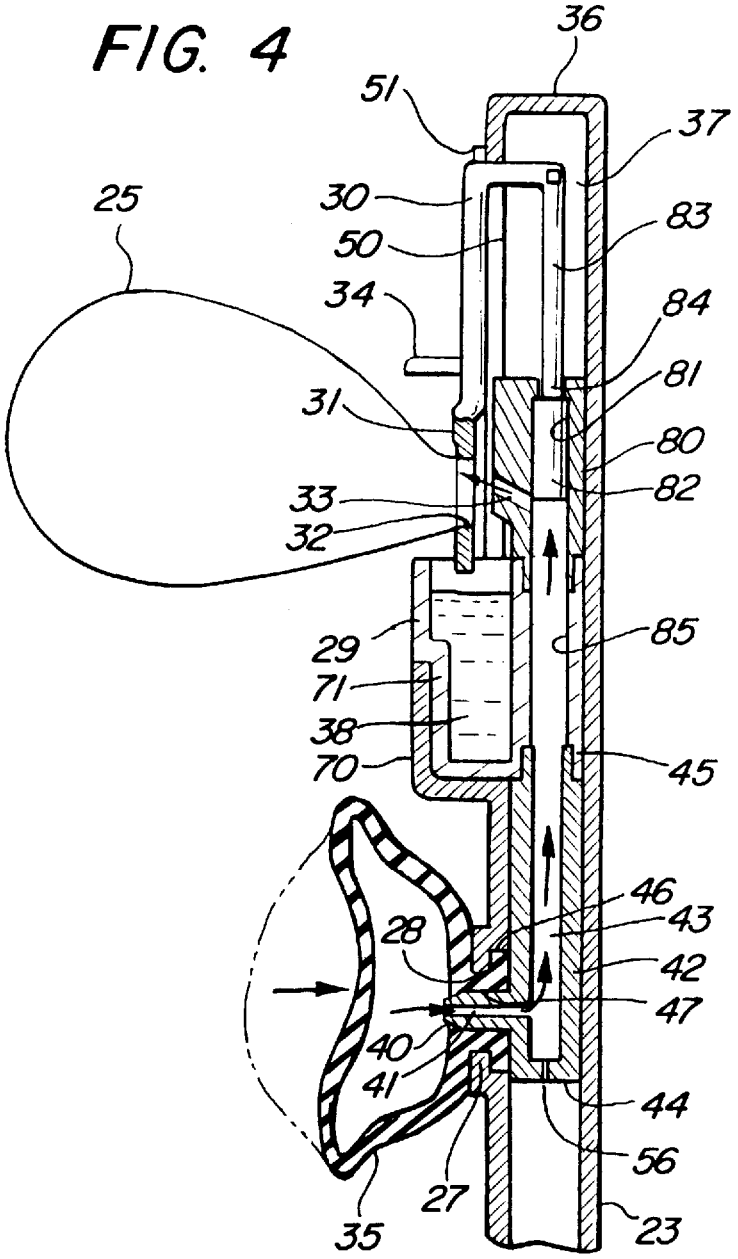
FIG. 4 sets forth a partial section view of the bubble producing portion of the present invention simulated diving mask and snorkel in the bubble producing position.

FIG. 4 sets forth the present invention apparatus in the bubble producing position in which the user continues to squeeze air bladder 35 and pressurized air is operative to raise slide 30 and force air outwardly through nozzle aperture 33 producing bubbles 25.

More specifically and as is set forth above, snorkel body 23 defines an interior passage 37 and an elongated slot 50. Snorkel body 23 further defines a closed end 36 and a fitting 27. Fitting 27 defines an aperture 28. An air bladder 35 defines an aperture 27 and a lip 46 configured to interlock with fitting 27 and secure air bladder 35 to snorkel body 23. Within passage 37 of snorkel 23, an elongated cylindrical plenum 42 having a chamber 43 and a closed end 44 is secured. Plenum 42 further includes a nozzle 40 having a passage 41 therethrough which extends into aperture 47 of air bladder 35. The resulting combination of plenum 42, fitting 27 and lip 46 of air bladder 35 secures air bladder 35 to snorkel body 23 in communication with chamber 43.

Snorkel body 23 further defines a reservoir support portion 70 which receives a reservoir tank unit 71. Tank unit 71 is preferably formed of a transparent material and includes a window 29 and a cylinder 85. Cylinder 85 receives a slidable piston 82. A cylindrical boss 45 extends upwardly from plenum 42 into tank unit 71. In the bubble-producing position shown in FIG. 4, piston 82 is driven upwardly against aperture 84 of nozzle body 80.

A movable slide 30 is slidably received within slot 50 and extends into passage 37 of snorkel body 23. A piston rod 83 couples the interior end of slide 30 to the upper end of piston 82 while the outer end of slide 30 supports cap 34 and bubble ring 31.

A nozzle body 80 is received within passage 37 of snorkel body 23 and defines a passage 81 and an upper aperture 84. Piston rod 83 extends downwardly through aperture 84 and passage 81. Also formed in nozzle body 80 is a nozzle aperture 33. In the preferred fabrication of the present invention, nozzle body 80 is sealingly secured to tank unit 71. As a result, the position of piston 82 at the upper end of passage 81 of nozzle body 80 allows air flow from chamber 43 of plenum 42 through nozzle aperture 33.

Thus, as the squeezing force continues to be applied to air bladder 35 compressing air bladder 35 and producing pressurized air therein, air flows outwardly from bladder 35 through nozzle passage 41 into chamber 43. Within chamber 43, the pressurized air forces piston 82 upwardly to its travel limit established by slot .50 and slide 30 to maintain the raised position of slide 30. It should be noted that with slide 30 raised, piston 82 is positioned in the topmost portion of passage 81 such that piston 82 no longer blocks air flow through nozzle aperture 33 of nozzle body 80. In addition, the raised position of slide 30 also aligns aperture 32 of bubble ring 31 with nozzle aperture 33. Accordingly, the outward flow of pressurized air from passage 81 through nozzle aperture 33 produces a bubble such as bubble 25. As the user continues to maintain the collapsed squeezing of air bladder 35, the pressurized air is slowly vented outwardly through nozzle aperture 33 producing a succession of bubbles until the bubble fluid held by ring 31 is exhausted and/or until the pressurized air supply within chamber 43 of plenum 42 is exhausted. In the absence of pressurized air within passage 81 and chamber 43 as well as cylinder 85, gravitational force upon the combined structure of slide 30, piston rod 83, piston 82 and bubble ring 31 returns the combined structure to the relaxed position shown in FIGS. 2 and 3. The user then releases air bladder 35 which due to its resilient material again expands to its relaxed position shown in FIG. 1. It will be recognized that the return of air bladder 35 to its expanded or relaxed position requires that air be able to flow into the interior of air bladder 35 under atmospheric pressure. As a practical matter, in the normal production tolerance of parts utilized in manufacturing the apparatus within snorkel body 23, it is anticipated that sufficient air leakage is available to allow air to be drawn into the interior of air bladder 35. Alternatively, however, a small vent aperture 56 may be formed at a convenient location such as closed end 44 as shown in FIG. 4 to provide a return air path which will allow air bladder 35 to reinflate or expand to its natural position when released. By way of further alternative, a one way valve may be supported in operational coupling to air bladder 35 which allows air to flow freely into the interior of the air bladder thereby allowing it to fill while preventing air flow outwardly through the valve when the air bladder is rapidly squeezed. In any event, the essential function with respect to the operation of the present invention apparatus is the ability to allow the resilience of air bladder 35 to return the air bladder to its normal expanded shape thereby filling the bladder interior with an air supply for the next operative cycle when the bladder is squeezed.

The repeated squeezing and release of air bladder 35 caused repeated intervals of bubble production from snorkel body 23 and simulates the bubbling action of diving apparatus. In this manner, the simulated diving mask and snorkel for a doll shown in the above descriptions will be understood to provide an amusing and entertaining simulation of a diving or swimming doll without the need for modifying the doll itself. Unlike prior art devices which have required substantial apparatus to be situated within the doll body, the present invention simulated diving mask and snorkel is readily moved from one doll to another to facilitate adaptation of virtually any suitably sized doll to a diving or swimming doll. The apparatus shown is easy to operate and presents an attractive and interesting amusement for child users.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A simulated diving mask and snorkel for a doll comprising:

a mask having a mask body, a faceplate and means for securing said mask body to a doll head;

a simulated snorkel having a mouthpiece joined to said mask body and a hollow snorkel body joined to said mouthpiece extending upwardly alongside said mask body;

a bubble fluid reservoir supported within said snorkel body having a quantity of bubble fluid disposed therein;

a resilient hollow air bladder having an air passage fitting;

a fitting joined to said snorkel body for receiving and securing said air passage fitting of said bladder;

a slide and piston movable within said snorkel body between a raised position and a lowered position;

a vent aperture formed within said snorkel body above said reservoir, said vent aperture being blocked from communication with said air bladder when said slide and piston are in said lower position; and a bubble ring joined to and supported by said slide, said bubble ring being immersed in said fluid when said slide is in said lowered position and raised to alignment with said vent aperture when said slide is in said raised position, whereby squeezing of said air bladder forces pressurized air into said snorkel body to raise said slide and piston and to vent air through said vent aperture thereby producing bubbles emanating from said snorkel body.

2. A simulated diving mask and snorkel for a doll as set forth in claim 1 wherein said bubble fluid reservoir defines an open top and wherein said slide includes a cap, formed to cover said open top, joined to said slide and closing said open top when said slide is in said lowered position.

3. A simulated diving mask and snorkel for a doll as set forth in claim 2 wherein said fitting includes a plenum supported within said snorkel body and having a nozzle coupled to said air passage fitting and an air passage directing air flow to said piston.

4. A simulated diving mask and snorkel for a doll as set forth in claim 3 wherein said snorkel body defines an interior cylinder within which said piston is moved by air from said air bladder.

5. A simulated diving mask and snorkel for a doll as set forth in claim 4 wherein said fluid reservoir includes a transparent window.

6. A simulated diving mask and snorkel for a doll as set forth in claim 5 wherein said air bladder is shaped to resemble a fish.

7. A simulated diving mask and snorkel for a doll as set forth in claim 1 wherein said air bladder is shaped to resemble a fish.

8. A simulated diving mask and snorkel for a doll as set forth in claim 1 wherein said fitting includes a plenum supported within said snorkel body and having a nozzle coupled to said air passage fitting and an air passage directing air flow to said piston.

9. A simulated diving mask and snorkel for a doll as set forth in claim 8 wherein said snorkel body defines an interior cylinder within which said piston is moved by air from said air bladder.

10. A simulated diving mask and snorkel for a doll as set forth in claim 9 wherein said fluid reservoir includes a transparent window.

11. A simulated diving mask and snorkel for a doll comprising:

a simulated diving mask having means for removable attachment to a doll's head;

a simulated snorkel having a mouthpiece joined to said simulated diving mask and having a reservoir supporting a bubble liquid;

air-driven bubble producing means supported within said simulated snorkel including a bubble ring normally resting in said reservoir and movable to an alternate position; and a resilient air bladder, formed to resemble a fish and joined to said simulated snorkel, producing air pressure flow to said bubble producing means when squeezed to cause said bubble producing means to raise said bubble ring from said reservoir and expose it to said air flow to produce bubbles, said air bladder giving the appearance of a fish swimming alongside said simulated snorkel and bubbles produced by said bubble producing means giving the appearance of a bubbling diving device operating under water.

* * * * *